US005217575A

United States Patent [19]

Backlund

[11] Patent Number: 5,217,575

[45] Date of Patent: Jun. 8, 1993

[54] PROCESS FOR OXYGEN BLEACHING USING TWO VERTICAL REACTORS

[75] Inventor: Ake Backlund, Karlstad, Sweden

[73] Assignee: Kamyr AB, Karlstad, Sweden

[21] Appl. No.: 857,121

[22] Filed: Mar. 24, 1992

Related U.S. Application Data

[63] Continuation of Ser. No. 657,959, Feb. 21, 1991, abandoned, which is a continuation of Ser. No. 416,467, Oct. 3, 1989, abandoned.

[30] Foreign Application Priority Data

Oct. 18, 1988 [SE] Sweden ..... 8803705

[51] Int. Cl.[5] ..... D21C 9/147

[52] U.S. Cl. ..... 162/65; 162/19; 162/57; 162/68

[58] Field of Search ..... 162/19, 47, 57, 65, 162/68

[56] References Cited

U.S. PATENT DOCUMENTS

| | | | |
|---|---|---|---|
| 3,944,463 | 3/1976 | Samuelson et al. | 162/65 |
| 4,806,203 | 2/1989 | Elton | 162/65 |
| 4,834,837 | 5/1989 | Loquenz | 162/65 |
| 4,886,577 | 12/1989 | Wiley | 162/57 |

OTHER PUBLICATIONS

Hsu et al, "Oxygen Bleaching Kinetics at Ultra-Low Consistency", Dec., 1987 TAPPI Journal, pp. 107-111.

Courchene et al, "Improvement of Medium Consistency . . . Control", Nov. 15-16, 1984, Oxygen Delignification Symposium, TAPPI Press, pp. 11-15.

Sunds Defibrator "Oxygen Delignification" brochure.

*Primary Examiner*—Steve Alvo

*Attorney, Agent, or Firm*—Cushman, Darby & Cushman

[57] ABSTRACT

A process for oxygen bleaching fibrous cellulose pulp is described in which the pulp passes a first delignification zone with a predetermined low temperature and a second delignification zone with a predetermined high temperature which is higher than that in the first delignification zone. The pulp is fed through a first vertical reactor containing said first delignification zone with low temperature, and thereafter through a second vertical reactor containing said second delignification zone with high temperature. The temperature in the first delignification zone is either maintained at the temperature that the pulp entering for bleaching has acquired during a previous treatment before the oxygen bleaching, or as required is adjusted by the controlled supply of steam to a mixer disposed in the pipe before the first reactor. The temperature in the second delignification zone is adjusted by the controlled supply of steam to a mixer disposed in the pipe between the two reactors.

3 Claims, 2 Drawing Sheets

□ Temp. 75/105°C
○ Temp. 85/105°C
△ Temp. 105/105°C
+ 1-stage, 105°C

PROCESS FOR OXYGEN BLEACHING USING TWO VERTICAL REACTORS

This is a continuation of application Ser. No. 07/657,959, filed on Feb. 21, 1991, which was abandoned upon the filing hereof Mar. 24, 1992 and which itself is a continuation of Ser. No. 07/416,467 filed Oct. 3, 1989, now abandoned.

FIELD AND BACKGROUND OF THE INVENTION

The present invention relates to a process for oxygen bleaching fibrous cellulose material.

In an article entitled "Oxygen bleaching kinetics at ultra-low consistency", Tappi Journal, December, 1987, by C.L. Hsu and Jeffrey S. Hsieh, it is described experiments with oxygen bleaching to study the influence of temperature on the viscosity. The results show that a high temperature in the initial stage of the oxygen bleaching has a negative effect on the viscosity.

However, in order to reach the normal range of kappa number in oxygen bleaching it is not possible to use a reaction temperature which is too low. For this purpose temperatures of about 100° C. are necessary, or special measures must be taken. Temperature control has thus been proposed to be carried out in oxygen bleaching pulp of medium consistency, see the article entitled "Improvement of medium consistency oxygen bleaching through temperature control" by C.C. Courchene and V.L. Magnotta, 1984, "Oxygen Delignification", pages 11 to 15. The oxygen delignification was performed in a horizontal tube reactor of laboratory size, to which steam was supplied at several points along the reactor in order to create two or more zones in which different temperatures could be maintained, the first zone having the lowest temperature. The experiments indicated that the temperature control with a low initial temperature in the horizontal tube reactor resulted in an improved yield and improved viscosity with the same retention time. However, the temperature control described cannot be applied with any great success on an industrial scale because of the difficulty in achieving an exact temperature limit between two temperature zones. This is partly due to the difficulty of efficiently and quickly mixing steam into the pulp in a uniform manner and also to the fact that the horizontal tube reactor, which contains a screw for feeding the pulp, has an upper space which is not filled by pulp but will instead contain a steam phase which disturbs the temperature control and extends along the entire length of the horizontal tube reactor.

SUMMARY OF THE INVENTION

The object of the present invention is to entirely eliminate the problems mentioned above and provide a process for oxygen bleaching which enables industrial utilization of the concept of having a lower temperature in the initial stage of the oxygen delignification and which enables efficient adjustment and control of the temperatures in the various delignification zones so that a constant low temperature and a constant high temperature, respectively, are obtained in the delignification zones without a disruptive steam phase appearing above the delignification zones.

The invention relates to a process for oxygen bleaching fibrous cellulose pulp comprising the steps of feeding the pulp through a first vertical reactor containing a first delignification zone with a predetermined low temperature, and thereafter through a second vertical reactor containing a second delignification zone with a predetermined high temperature that is higher than that in the first delignification zone, the temperature in the first delignification zone being either maintained at the temperature that the pulp entering for bleaching has acquired during a previous treatment before the oxygen bleaching, or as required being adjusted by the controlled supply of steam to a mixer disposed in the pipe before the first reactor, and the temperature in the second delignification zone being adjusted by the controlled supply of steam to a mixer disposed in the pipe between said two reactors.

BRIEF DESCRIPTION OF THE DRAWINGS

The invention will be described further in the following with reference to the drawings, in which.

DESCRIPTION OF ILLUSTRATED EMBODIMENT

Figure 1:
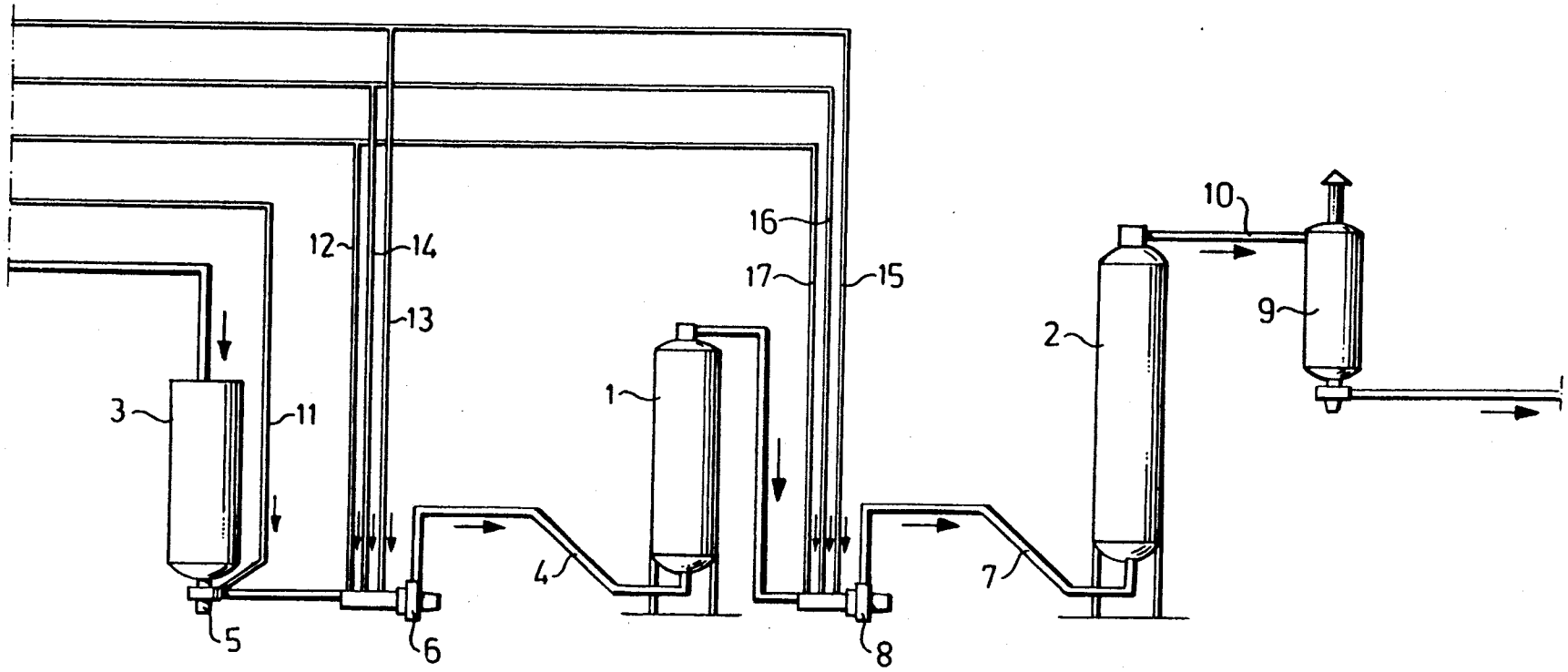
FIG. 1 shows schematically a bleaching plant for carrying out the process according to the invention.

The bleaching plant shown in FIG. 1 is designed for oxygen bleaching in two distinct stages and comprises a first reactor 1 and a second reactor 2. The pulp is supplied from a storage tank 3 to the first reactor 1 through a pipe 4 and by means of a pump 5 at the outlet of the storage tank 3, and a mixer 6, i.e. an apparatus for mixing treating agents, into the pipe 4. The mixer 6 contains fluidization means to rapidly and homogenously mix the various additives into the pulp. The mixer is preferably a "Kamyr MC mixer". The pulp to be bleached is thus of medium consistency, i.e. about 6–15%.

FIG. 1 further shows that pulp and chemicals are added at the first mixer (6) and passed directly from the first mixer to the first reactor (1). The reacted pulp and residual chemicals from the first reactor (1) are passed directly from the first reactor to a second mixer (8), and the pulp and chemicals added at the second mixer are passed directly from the second mixer (8) to the second reactor (2).

The reactors 1 and 2 are connected to each other by a pipe 7 containing a mixer 8 of the same type as that described above. The oxygen-delignified pulp is transferred from the second reactor 2 to a blow tank 9 through a pipe 10.

A protective agent for the cellulose, e.g. $MgSO_4$, is added via a pipe 11 at the outlet from the storage tank 3. An alkaline agent such as NaOH or oxidized white liquor is supplied through a pipe 12 and oxygen gas through a pipe 13 to the first mixer 6 with high mixing efficiency. Further, a pipe 14 for high-pressure steam is connected to the mixer 6. Pipes 15, 16 supplying oxygen gas and high-pressure steam, respectively, are connected to the second mixer 8. A pipe 17 may also be provided for the addition of further alkaline agent to the pulp which has been oxygen-delignified in a first stage.

The bleaching plant also contains suitable measuring and control means (not shown) for measuring the temperature in the two reactors and controlling the supply of steam to the mixers to ensure that the correct different temperatures are maintained in the two reactors in accordance with the present invention.

The first reactor 1 comprises a first delignification zone with a low temperature within the interval 70°

C.-90° C., preferably 75° C.-85° C., while the second reactor 2 comprises a second delignification zone with a high temperature within the interval 90° C.-125° C., preferably 95° C.-110° C. The terms "low" and "high" thus relate to the mutual relationship between the temperatures in the two delignification zones. The temperature difference between the two delignification zones shall be about 20° C.-40° C., preferably about 30° C.

In such cases when the pulp entering for bleaching has a sufficient temperature level, acquired in a previous treatment before the oxygen bleaching, corresponding to the term "low temperature", i.e. within the interval 70° C.-90° C., no steam need generally be supplied to the first mixer 6 provided the temperature is constant or substantially constant.

The following example illustrates the invention further.

EXAMPLE

Figure 2:
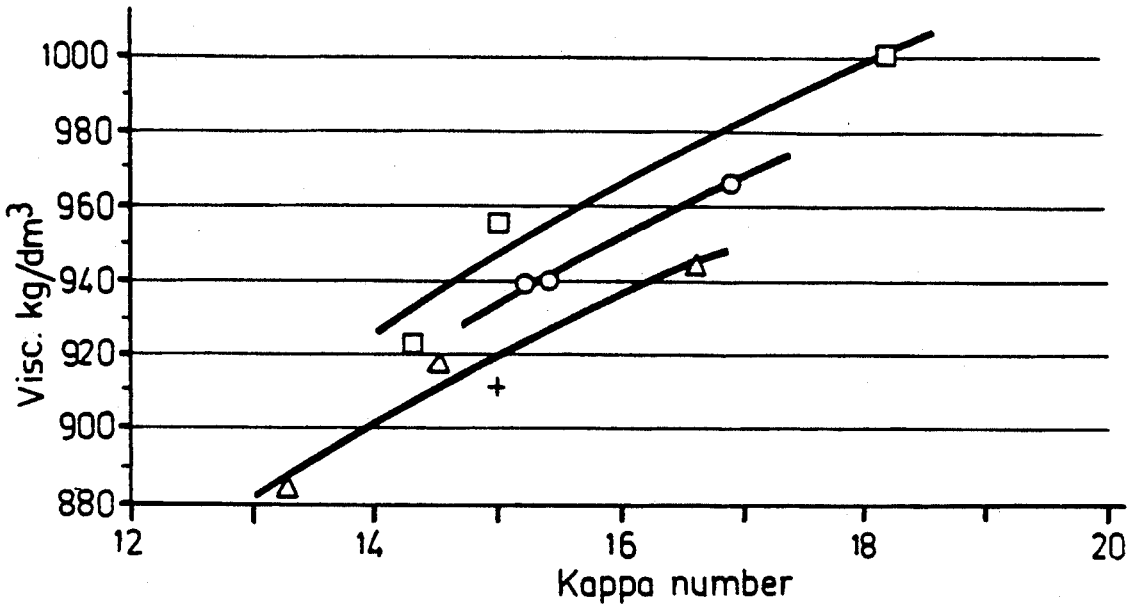
FIG. 2 is a diagram illustrating the relationship between kappa number and viscosity.

Oxygen delignification in two stages was carried out in a bleaching plant as shown in FIG. 1. The temperature was varied in three different test series. In the first test the temperature in the first stage (first delignification zone) was 75° C., in the second test it was 85° C. and in the third test it was 105° C., whereas the temperature in the second stage (second delignification zone) in all three tests was 105° C. The pulp of soft wood to be oxygen bleached had a kappa number of 28.7, a viscosity of 1141 $dm^3/kg$ and a consistency of 10%. The initial pressure (super atmospheric pressure) was about 0.5 Mpa in both delignification zones, i.e. stages 1 and 2, and the treatment time in all the tests was 15 min in stage 1 and 45 min in stage 2. 5 kg $MgSO_4$ per ton of dry pulp was added through pipe 11 at pump 5. Each test was repeated with the single difference that in the first case 20 kg NaOH per ton of dry pulp was used, in the second case 25 kg NaOH and in the third case 30 kg NaOH per ton of dry pulp, except in the first test where in the second case 30 kg NaOH was used and the third case 35 kg NaOH per ton of dry pulp was used (instead of 25 and 30 kg, respectively). In general an increased alkali charge will give a lower kappa number and lower viscosity with otherwise identical conditions. Further, a fourth test was carried out in which the oxygen delignification was performed in one stage at 105° C. for 60 minutes and with an alkali charge of 30 kg NaOH per ton of dry pulp. The results can be seen in the diagram in FIG. 2. The values indicated to the right in this diagram thus refer to the lowest alkali charge of the three tests (20 kg), whereas the values to the left refer to the largest alkali charge (35, 30, 30 kg).

The results indicate that a high temperature in the initial stage of the oxygen delignification has a negative effect on the viscosity and that a low temperature in the initial stage produces an oxygen-delignified pulp with improved viscosity and with a kappa number lying within the normal and desired range. Furthermore, the diagram shows that a low temperature in the first stage of the oxygen delignification produces 15 to 30 units higher viscosity measured at the same kappa number when compared with oxygen delignification performed at high temperature in both stages, and 25-40 units higher viscosity measured at the same kappa number when compared with oxygen delignification performed in a single step and at high temperature. This effect can either be utilized to produce a pulp with better strength properties, or to lower the kappa number of the oxygen-delignified pulp by 1-2 units while retaining the same viscosity. The latter procedure is interesting from the environmental aspect since it results in a reduction in the chlorine consumption in the subsequent bleaching plant and with that, a corresponding reduction in the discharge of organic chlorine compounds.

Since the delignification zones are disposed at a distance from each other, viz. in individual reactors 1, 2, no disruptive steam phase appears above and between the delignification zones. Furthermore, effective adjustment and control of the temperatures in the different delignification zones are achieved by supplying steam to the mixers 6, 8 before the reactors 1, 2. The mixers produce homogenous mixing of the steam into the pulp so that a constant low temperature can be maintained without any problem in the first reactor, and a constant high temperature can likewise be maintained without problem in the second reactor.

That which is claimed is:

1. A process for oxygen bleaching fibrous cellulosic pulp comprising, utilizing a first vertical reactor having a first delignification zone, and a second vertical reactor having a second delignification zone, wherein said first delignification zone is comprised of a first mixer and said first vertical reactor; and said second delignification zone is comprised of a second mixer and said vertical second reactor; and wherein said cellulosic pulp and chemicals are added at said first mixer and passed directly from said first mixer to said first vertical reactor and wherein reacted pulp and residual chemicals from said first vertical reactor are passed directly from said first vertical reactor to said second mixer and wherein said reacted pulp and residual chemicals are passed directly from said second mixer to said second vertical reactor further comprising the steps of:

(a) feeding the pulp through the first delignification zone of the first vertical reactor while maintaining a predetermined low temperature within the range of 70° C.-90° C., while practicing oxygen delignification;

(b) after step (a), passing the pulp from the first delignification zone to the second delignification zone without any intervening filtration being performed during the passage;

(c) after step (b), feeding the pulp through the second delignification zone of the second vertical reactor while maintaining the pulp at a predetermined high temperature within the range of 90° C.-125° C. and that is higher than said low temperature by about 20° C.-40° C., while practicing oxygen delignification;

(d) practicing step (a) by introducing pulp into the first delignification zone that has said predetermined low temperature; and (e) maintaining the pulp in the second delignification zone at said higher temperature by mixing the pulp with high temperature fluid during step (b).

2. A process for oxygen bleaching fibrous cellulosic pulp comprising, utilizing a first vertical reactor having a first delignification zone, and a second vertical reactor having a second delignification zone, wherein said first delignification zone is comprised of a first mixer and said first vertical reactor; and said second delignification zone is comprised of a second mixer and said vertical second reactor; and wherein said cellulosic pulp and chemicals are added at said first mixer and passed directly from said first mixer to said first vertical reactor and wherein reacted pulp and residual chemicals from said first vertical reactor are passed directly from said first vertical reactor to said second mixer and wherein said reacted pulp and residual chemicals are passed directly from said second mixer to said second vertical reactor further comprising the steps of:

(a) feeding the pulp through the first delignification zone of the first vertical reactor while maintaining a predetermined low temperature within the range of 75° C.–85° C., while practicing oxygen delignification;

(b) after step (a), feeding the pulp through the second delignification zone of the second vertical reactor while maintaining the pulp at a predetermined high temperature within the range of 95° C.–110° C. that is higher than said low temperature by about 30° C., while practicing oxygen delignification;

(c) practicing step (a) by introducing pulp into the first delignification zone that has said predetermined low temperature; and (d) maintaining the pulp in the second delignification zone at said higher temperature by mixing the pulp with high temperature fluid between steps (a) and (b).

3. A process for oxygen bleaching fibrous cellulosic pulp comprising, utilizing a first vertical reactor having a first delignification zone, and a second vertical reactor having a second delignification zone, wherein said first delignification zone is comprised of a first mixer and said first vertical reactor; and said second delignification zone is comprised of a second mixer and said vertical second reactor; and wherein said cellulosic pulp and chemicals are added at said first mixer and passed directly from said first mixer to said first vertical reactor and wherein reacted pulp and residual chemicals from said first vertical reactor are passed directly from said first vertical reactor to said second mixer and wherein said reacted pulp and residual chemicals are passed directly from said second mixer to said second vertical reactor further comprising the steps of:

(a) feeding the pulp through the first delignification zone of the first vertical reactor while maintaining a predetermined low temperature within the range of 70° C.–90° C., while practicing oxygen delignification;

(b) after step (a), feeding the pulp through the second delignification zone of the second vertical reactor while maintaining the pulp at a predetermined high temperature within the range of 90° C.–125° C. and that is higher than said low temperature by about 20° C.–40° C., while practicing oxygen delignification;

(c) practicing step (a) by introducing pulp into the first delignification zone that has said predetermined low temperature; and (d) maintaining the pulp in the second delignification zone at said higher temperature by mixing the pulp with high temperature fluid between steps (a) and (b).

* * * * *